US010676888B1

(12) United States Patent
Kruse et al.

(10) Patent No.: US 10,676,888 B1
(45) Date of Patent: Jun. 9, 2020

(54) CORRUGATED SHELL BEARING PILES AND INSTALLATION METHODS

(71) Applicant: William Jordan LLC, Albuquerque, NM (US)

(72) Inventors: William C. Kruse, Clark, NJ (US); Jordan R. Twist, Newport Beach, CA (US); William E. Kruse, Plainfield, NJ (US)

(73) Assignee: William Jordan LLC, Albuquerque, NM (US)

( * ) Notice: Subject to any disclaimer, the term of this patent is extended or adjusted under 35 U.S.C. 154(b) by 0 days.

(21) Appl. No.: 16/655,131

(22) Filed: Oct. 16, 2019

(51) Int. Cl.

| | |
|---|---|
| ***E02D 5/22*** | (2006.01) |
| ***E02D 5/52*** | (2006.01) |
| ***E02D 5/28*** | (2006.01) |
| ***E02D 5/38*** | (2006.01) |

(52) U.S. Cl.
CPC ..... *E02D 5/526* (2013.01); *E02D 5/285* (2013.01); *E02D 5/38* (2013.01); *E02D 2200/12* (2013.01); *E02D 2200/1671* (2013.01); *E02D 2250/0023* (2013.01); *E02D 2300/0032* (2013.01); *E02D 2600/20* (2013.01)

(58) Field of Classification Search
CPC .. E02D 5/34; E02D 5/52; E02D 5/526; E02D 5/30; E02D 5/285; E02D 2200/12; E02D 2200/1671; E02D 2250/0023
See application file for complete search history.

(56) References Cited

U.S. PATENT DOCUMENTS

| | | | | | |
|---|---|---|---|---|---|
| 433,609 | A | * | 8/1890 | Ames | E02D 5/30 405/256 |
| 1,342,424 | A | * | 6/1920 | Cotten | E02D 5/52 405/253 |
| 1,778,925 | A | | 10/1930 | Thornley | |
| 1,836,140 | A | | 12/1931 | Upson | |
| 2,270,604 | A | * | 1/1942 | Roemhild | E02D 5/52 285/119 |
| 2,288,576 | A | * | 6/1942 | Titcomb | E02D 5/52 405/251 |
| 2,554,896 | A | | 5/1951 | Caudill | |
| 2,911,795 | A | | 11/1959 | Cobi | |
| 2,924,949 | A | * | 2/1960 | Smith | E02D 5/665 405/251 |
| 3,279,136 | A | | 10/1966 | Smith | |
| 3,395,543 | A | | 8/1968 | Rusche | |
| 3,638,433 | A | * | 2/1972 | Sherard | E02D 1/04 405/50 |
| 3,779,025 | A | | 12/1973 | Godley et al. | |
| 3,851,485 | A | * | 12/1974 | Steding | E02D 5/34 405/233 |
| 3,913,337 | A | | 10/1975 | Merjan | |
| 3,971,227 | A | | 7/1976 | Godley | |
| 4,199,277 | A | * | 4/1980 | Merjan | E02D 5/30 405/250 |

(Continued)

FOREIGN PATENT DOCUMENTS

| | | | |
|---|---|---|---|
| CN | 109058604 | A | 12/2018 |
| KR | 200292305 | Y1 | 10/2002 |
| KR | 1020100086110 | A | 7/2010 |

*Primary Examiner* — Benjamin F Fiorello
(74) *Attorney, Agent, or Firm* — Knobbe Martens Olson & Bear LLP

(57) ABSTRACT

A bearing pile including a plurality of connected corrugated steel shells inserted into a subsoil and installation methodology of the same.

30 Claims, 7 Drawing Sheets

(56) References Cited

U.S. PATENT DOCUMENTS

| | | | | |
|---|---|---|---|---|
| 4,349,298 | A | 9/1982 | Kruse | |
| 4,462,716 | A | 7/1984 | Merjan | |
| 4,543,015 | A | 9/1985 | Kruse | |
| 4,725,167 | A | 2/1988 | Merjan | |
| 5,826,387 | A | 10/1998 | Henderson et al. | |
| 5,862,581 | A | 1/1999 | Miller et al. | |
| 6,264,403 | B1 * | 7/2001 | Hall | E02D 5/54 405/231 |
| 6,367,849 | B1 | 4/2002 | Tatsuta | |
| 6,468,003 | B2 * | 10/2002 | Merjan | E02D 5/38 285/148.22 |
| 6,543,967 | B1 * | 4/2003 | Marshall | E02D 5/52 405/239 |
| 6,609,856 | B1 * | 8/2003 | Knight | E02D 5/523 405/230 |
| 7,707,797 | B2 | 5/2010 | Henderson | |
| 8,579,548 | B1 * | 11/2013 | Schmidt | E02D 5/64 405/251 |
| 8,864,182 | B2 | 10/2014 | Buchanan et al. | |
| 2012/0014755 | A1 | 1/2012 | Raunisto | |
| 2013/0153078 | A1 * | 6/2013 | Twist | F16L 9/06 138/173 |
| 2015/0354162 | A1 * | 12/2015 | Bonomi | E02D 5/20 405/287.1 |
| 2019/0071838 | A1 | 3/2019 | Zhan | |

* cited by examiner

CORRUGATED SHELL BEARING PILES AND INSTALLATION METHODS

BACKGROUND

Field

This disclosure generally relates to bearing piles used in deep foundations of buildings, roads, bridges, and other structures.

Related Art

At certain building sites, existing subsoil properties may be inadequate to safely support a large or heavy structure. Deep foundations, such as bearing piles, are used to provide support to structures such as buildings, roads, and bridges. Bearing piles are generally vertical or battered structural elements that are driven into a subsoil. Depending on the subsoil properties and the designed loads, a quantity of bearing piles may ultimately be installed to support the structure.

SUMMARY

Various bearing pile structures and methods of installing a bearing pile exist. However, each of these structures and methods has certain limitations that are solved or improved upon by one or several aspects of the present disclosure.

In one aspect, the bearing piles disclosed herein comprise relatively light gauge corrugated pipes (hereinafter: corrugated shells). The corrugations in the corrugated shells act to provide an enhanced resistance to radially inward forces from the subsoil and compression and tension forces during installation (e.g., as compared with straight or smooth-walled pipes). The corrugations provide resistance to deformation both during driving and at final depth. The corrugations also allow for less material to be used as compared with smooth-walled pipes. For a given wall thickness, corrugated steel shells have a greater crush resistance and bending resistance than smooth-walled pipes. To achieve the same crush or bending resistance, smooth-walled pipes require thicker walls. The additional material from the thicker wall increases the total weight and cost of the smooth-walled pipes.

In another aspect, the bearing depths of the bearing piles disclosed herein can be easily varied to provide the desired loading capacity of the bearing pile. Deeper bearing depths can increase the loading capacity. Also, the bearing depths can be selected such that one or more corrugated shells are located within a bearing stratum. In certain implementations, the lengths of the corrugated shells and/or the number of corrugated shells attached together according to a segment-by-segment installation methodology can be varied to achieve the desired bearing depth and the loading capacity. The segment-by-segment installation methodology can be performed more rapidly than alternative foundation elements currently employed, without damage to the corrugated shells, resulting in reduced installation, transportation, material costs and visually confirmed structural integrity in the final bearing pile.

In another aspect, the diameters of the corrugated shells of the bearing piles can be varied to provide the desired loading capacity of the pile and/or to lessen downdrag forces on the bearing piles. In addition, the corrugations of the corrugated shells trap portions of the subsoil surrounding the corrugated shells within valleys (e.g., between flute crests). The trapped subsoil portions create a soil-soil shear interface that increases the loading capacity of the bearing pile as compared with a metal-soil shear interface of smooth-walled pipes. The corrugated shell bearing piles have a greater loading capacity for the same length and diameter compared with bearing piles using smooth-walled pipes.

According to one aspect, a method of forming a foundational piling in a subsoil, includes attaching a cap (boot plate) with a first end of a first corrugated shell, the first corrugated shell includes corrugated steel pipe having a plurality of corrugations. The cap encloses the first end of the first corrugated shell. A drive mandrel inserts into a second end of the first corrugated shell. The drive mandrel has a mandrel length. The mandrel length is greater than a length of the first corrugated shell. The first corrugated shell aligns with the subsoil along a generally vertical, or battered angle, direction. The cap of the first corrugated shell contacts the subsoil and the second end of the first corrugated shell is raised above the subsoil. A pile impact or vibratory hammer contacts with an upper end of the drive mandrel or at the second end of the first corrugated shell. A lower end of the drive mandrel contacts the cap. A driving force applies to the drive mandrel in the vertical, or battered, direction using the pile impact or vibratory hammer. The driving force can include driving, pressing and/or vibrating forces. The driving force transmits along the mandrel to the first corrugated shell through the cap such that the first corrugated shell is tensioned during driving. The first end of the first corrugated shell is driven into the subsoil with the driving force to attain a first fill position in which a majority of the length of the first corrugated shell is embedded within the subsoil. The second end of the first corrugated shell is located between 6 and approximately 36 inches above the subsoil (or higher). The mandrel is then removed from the first corrugated shell in the vertical direction. The first corrugated shell is filled from the first end to the second end with a flowable concrete mix in the first fill position and cures into a solid concrete.

A coupler sleeve attaches with the first corrugated shell by assembling a first rim of a first end of the coupler sleeve over the second end of the first corrugated shell and engaging the corrugations of the first corrugated shell with internal threads of the first end of the coupler sleeve. A second corrugated shell aligns with the longitudinal axis of the first corrugated shell. The second end of the first corrugated shell raises above the subsoil. The second corrugated shell includes corrugated steel pipe having a plurality of corrugations second corrugated shell. The second corrugated shell with the coupler sleeve assembles with first end of the second corrugated shell be insertion within a second rim of a second end of the coupler sleeve opposite the first end and engages the corrugations of the second corrugated shell with internal threads.

The drive mandrel inserts into a second end of the second corrugated shell. The mandrel length is greater than a length of the second corrugated shell. The pile impact or vibratory hammer contacts with the upper end of the drive mandrel at the second end of the second corrugated shell. The lower end of the drive mandrel contacts the solid concrete or a steel bearing plate on the concrete of the first corrugated shell.

The driving force is applied to the drive mandrel in the vertical, or battered, direction using the pile impact or vibratory hammer. The driving force transmits along the mandrel to the first and second corrugated shells such that the second corrugated shell is tensioned during driving and the first corrugated shell and the solid concrete is compressed during driving. The first and second corrugated shells are driven into the subsoil with the driving force to attain a second fill position in which the first corrugated shell is buried within the subsoil and a majority of the second corrugated shell is buried within the subsoil. A first end of a reinforcing cage may be inserted into the second end of the second corrugated shell. A second end of the reinforcing cage protrudes therefrom. The second corrugated shell is filled from the first end to the second end with the flowable concrete mix and curing the wet concrete mix to a solid concrete with the reinforcing cage embedded therein.

In another aspect, the subsoil is forced into valleys of the corrugations of the first and second corrugated shells during driving such that a piling capacity of the foundational piling is at least partially determined by a soil/soil shear interface between the subsoil trapped within the valleys and the subsoil surrounding an outer circumferential wall of the first and second corrugated shells.

In another aspect, the length of the first corrugated shell is up to 90 feet and the length of the second corrugated shell is up to 90 feet.

In another aspect, the corrugations of the first and second corrugated shells have a helix angle between about 4 degrees and 45 degrees.

In another aspect, the corrugations of the first and second corrugated shells have a pitch distance (crest to crest) of between about ¼ inches and 6 inches.

In another aspect, the corrugations of the first and second corrugated shells have a flute depth between about ¼ inches and 3 inches.

In another aspect, the first and second corrugated shells have a wall thickness between about 0.03 inches and ¼ inches.

In another aspect, the first and second corrugated shells each have a diameter between about 6 inches and 36 inches.

According to another aspect, a method of forming a foundational piling in a subsoil, includes attaching a cap with a first end of a first corrugated shell, the first corrugated shell includes corrugated steel pipe having a plurality of corrugations. The first corrugated shell is aligned with the subsoil along an insertion direction. The cap of the first corrugated shell contacts the subsoil and the second end of the first corrugated shell is located above the subsoil. A driving force is applied to the first corrugated shell in the insertion direction with a pile impact or vibratory hammer. The first end of the first corrugated shell is driven or vibrated into the subsoil with the driving force or vibrations to attain a first fill position in which a majority of the length of the first corrugated shell is buried within the subsoil and the second end of the first corrugated shell is spaced above the subsoil. The first corrugated shell is filled with a flowable concrete mix in the first fill position and cures to a solid concrete. A first end of a second corrugated shell couples with the second end of the first corrugated shell to form a shell assembly. The second corrugated shell includes corrugated steel pipe having a plurality of corrugations. A drive mandrel inserts into a second end of the second corrugated shell. The second corrugated shell with the first corrugated shell inserts along the insertion direction, the second end of the first corrugated shell located above the subsoil. The driving force applies to the drive mandrel in the insertion direction using the pile impact or vibratory hammer. The driving force transmits along the mandrel to the first and second corrugated shells such that the second corrugated shell is tensioned during driving and the first corrugated shell and the solid concrete is compressed during driving. The shell assembly into the subsoil with the driving force to attain a second fill position in which the length of the first corrugated shell is buried within the subsoil, a majority of a length of the second corrugated shell is buried within the subsoil. The mandrel is removed from the second corrugated shell and the second corrugated shell is filled with the flowable concrete mix.

In another aspect, the drive mandrel is inserted into the second end of the first corrugated shell to apply the driving force to the first corrugated shell in the insertion direction.

In another aspect, the insertion direction is generally vertical or along a specified batter.

In another aspect, a coupler attaches with the first corrugated shell by assembling a first rim of a first end of the coupler over the second end of the first corrugated shell. The second corrugated shell attaches with the coupler by assembling a first end of the second corrugated shell within a second rim of a second end of the coupler opposite the first end.

In another aspect, the corrugations of the first corrugated shell engage with internal threads of the first end of the coupler. The corrugations of the second corrugated shell engage with internal threads of the second end of the coupler.

In another aspect, a lower end of the drive mandrel bears upon a central portion of the coupler.

In another aspect, the second corrugated shell has an outer diameter less than an outer diameter of the first corrugated shell.

In another aspect, the second corrugated shell has a diameter greater than a diameter of the first corrugated shell.

In another aspect, the subsoil is forced into valleys of the plurality of corrugations of the first corrugated shell during driving such that a piling capacity of the foundational piling is at least partially determined by a soil/soil interface between the subsoil within the valleys and the subsoil around the first corrugated shell.

In another aspect, a first end of a coupling rod inserts within in the flowable concrete mix in the second end of the first corrugated shell and a second end of the coupling rod inserts within the first end of the second corrugated shell when the second corrugated shell attaches with the first corrugated shell.

In another aspect, the length of the first corrugated shell is up to 90 feet and the length of the second corrugated shell is up to 90 feet.

In another aspect, the corrugations of the first and second corrugated shells have a helix angle between about 4 and 45 degrees.

In another aspect, the corrugations of the first and second corrugated shells have a pitch distance (crest to crest) of between about ¼ inches and 6 inches.

In another aspect, the corrugations of the first and second corrugated shells have a flute depth between about ¼ and 3 inches.

In another aspect, the first and second corrugated shells have a thickness between about 0.03 inches and ¼ inches.

In another aspect, the first and second corrugated shells each have a diameter between about 6 inches and 36 inches.

In another aspect, the plurality of corrugations of the first corrugated shell have a standard profile.

In another aspect, a first end of a reinforcing cage inserts into the second end of the second corrugated shell and a second end of the reinforcing cage protrudes therefrom.

In another aspect, the first end of the first corrugated shell is received within an outer rim of the cap.

In another aspect, a third corrugated shell attaches with the second end of the second corrugated shell. The third corrugated shell includes corrugated steel pipe having a plurality of corrugations and is driven into the subsoil with the drive mandrel.

In another aspect, the second corrugated shell has a diameter less than a diameter of the first corrugated shell and the third corrugated shell has a diameter less than the diameter of the first corrugated shell.

In another aspect, the second corrugated shell has a diameter greater than a diameter of the first corrugated shell and the third corrugated shell has a diameter greater than the diameter of the second corrugated shell.

According to another aspect, a foundational piling in a subsoil, includes a first corrugated shell of corrugated steel pipe having a plurality of corrugations. A length of the first corrugated shell is up to 90 feet and a diameter of the first corrugated shell is between 6 inches and 36 inches. A cap attaches to a first end of the first corrugated shell, the first corrugated shell aligned in a substantially vertical direction or a battered direction. A first cured concrete section fills the first corrugated shell from the first end a second end of the first corrugated shell. A second corrugated shell includes corrugated steel pipe having a plurality of corrugations. A length of the second corrugated shell is up to 90 feet and a diameter of the second corrugated shell is between 6 inches and 36 inches. A first end of the second corrugated shell attaches with the second end of the first corrugated shell. A second cured concrete section filling the second corrugated shell.

In another aspect, a coupler attaches the second end of the first corrugated shell with the first end of the first corrugated shell.

In another aspect, the coupler includes a central portion of the coupler separating the first cured concrete section and the second cured concrete section.

In another aspect, the coupler includes a first end having a first rim and a second end having a second rim, the second end of the first corrugated shell received within the first rim and the first end of the second corrugated shell receive within the second rim.

In another aspect, the corrugations of the second end of the first corrugated shell are engaged within the first end of the coupler.

In another aspect, a reinforcing cage is embedded in the second cured concrete section and extends from the second end of the second corrugated shell.

In another aspect, the diameter of the second corrugated shell is less than the diameter of the first corrugated shell.

In another aspect, the diameter of the second corrugated shell is greater than the diameter of the first corrugated shell.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein

BRIEF DESCRIPTION OF THE DRAWINGS

Various examples are depicted in the accompanying drawings for illustrative purposes and should in no way be interpreted as limiting the scope of the examples. Various features of different disclosed examples can be combined to form additional examples, which are part of this disclosure.

DETAILED DESCRIPTION

Introduction

Figure 1:
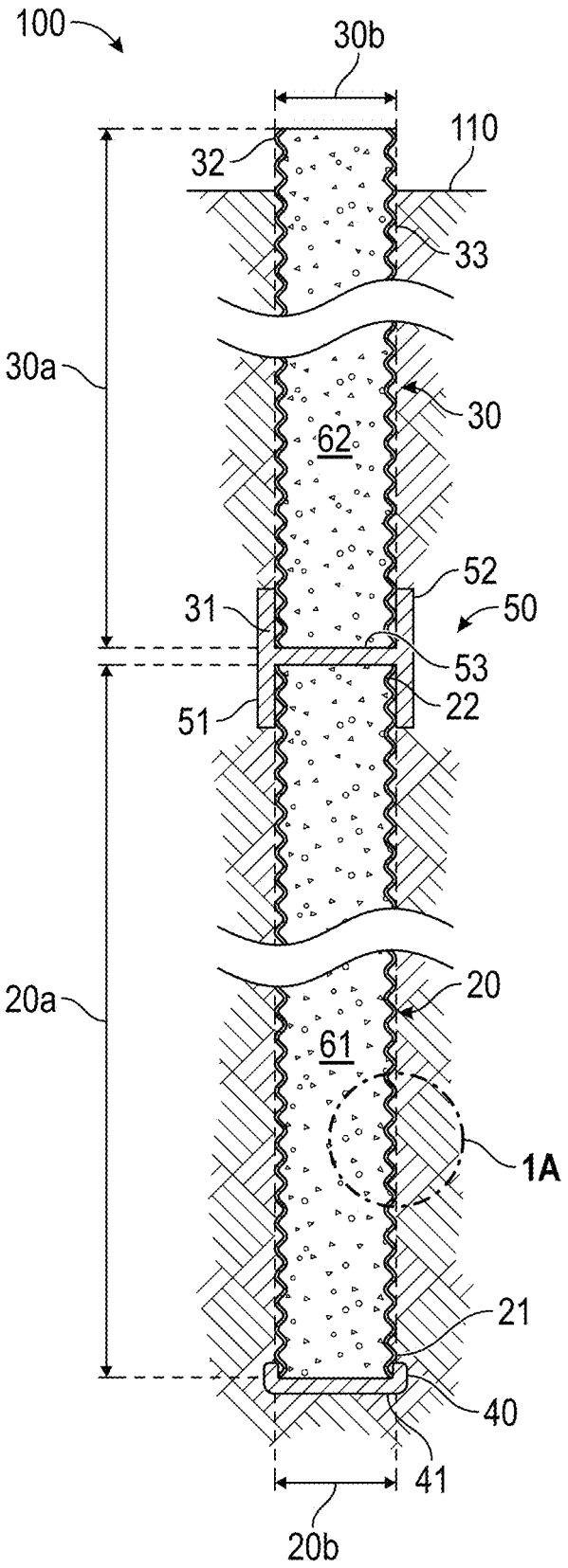
FIG. 1 illustrates a bearing pile including first and second corrugated shells installed within a subsoil.
Figure 1A:
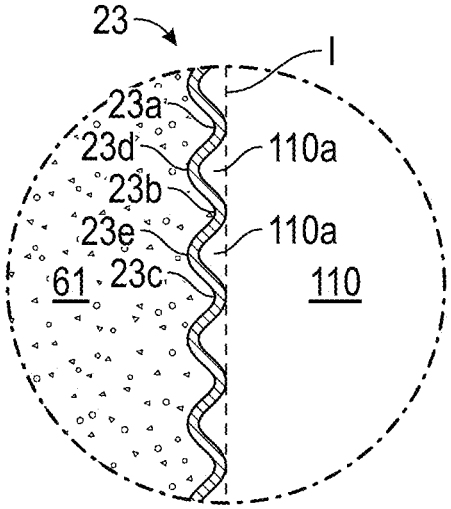
FIG. 1A illustrates a detail of FIG. 1.

Bearing piles currently utilized to support heavy foundations fall into four major categories: precast-prestressed concrete, steel H sections, smooth wall tubular pipe which is customarily filed with concrete, and varieties of "grout piles" that are pumped or dumped into the ground by variety of methods.

The subsoil profile that typically requires piling may include upper layers of soft compressible materials that are incapable of supporting the new structure absent intolerable settlement. The pile penetrates these unsuitable soils and is advanced into, or onto, competent soils, and or rock, which are capable of supporting the transmitted loads without excessive settlement. Precast, H and pipe piles are most frequently installed by driving them on the top with an impact hammer designed for that purpose. The hammer is fitted with a heavy ram that travels up and down, and strikes the pile, or more often, an intermediate cushion material that absorbs some of the energy preventing damage to the pile butt (top). The driving force imparted to the pile, or to the pile through the cushion, generates compression and tension waves in the pile which travel down to the tip and reflect back up the pile. If the compression or tension stress generated during driving exceeds the strength of the pile material, the pile can be damaged and rendered unsuitable for use.

It is essential that the subsoil into which the pile is driven is capable of accepting the load applied absent excessive pile settlement. The subsoil interaction with the pile is a function of the pile's shape, volume, and surface characteristics such as smoothness, or roughness, and profile. Absent an impenetrable barrier, such as rock, typically the deeper the pile penetration into suitable soil, the greater the pile capacity. The materials that the pile comprises should be analyzed to assure they are sufficient to accept the loads imposed from the new construction, which may include: compressive, tensile, bending, shear, vibratory and seismic forces. A competent pile foundation design should also consider the pile-soil-hammer relationship, and the level of confidence in the integrity of the installation.

Piles derive their support from a combination of the useful friction developed along their sides, and the end bearing which occurs at the lower end of the pile. Steel H piles are efficient when the tips bear on or in dense soil or rock which enables them to obtain high end bearing capacity. As the design load increases, it may be necessary to increase the size and therefore the weight of the H pile with concomitant increases in cost. In many locations, a friction pile that derives its principal support along the sides rather than at the tip will come to bear at much higher elevations than it would be necessary to drive the H pile, rendering the H pile uneconomical. Since H piles are rolled at a mill they must be transported and bear the costs of handling and transportation. The lengths required must be provided in advance of the pile driving operations so that if the soil conditions encountered differ from what was anticipated the ordered lengths may be too short, and require expensive and time-consuming splicing or alternatively they are too long which there is excessive waste. If the H pile is damaged during driving rendering the H pile unsuitable for use, the damage may be unseen and undetected.

Precast concrete piles have limitations as to the length to which they can be cast. Due to their weight and fragility they are expensive to transport and require heavy equipment to handle and loft under the pile hammer. A direct blow from the ram point can crush the butt. To obviate this a thick, expendable, wood cushion is typically placed on the top of each pile. This protects the pile from damage and increases the drive time since the cushion absorbs a portion of the useful energy delivered from the hammer. The energy wave that travels through the pile creates tensile as well as compressive stresses. In precast piles, particularly when the precast pile enters a resistant soil as it exits a soft stratum, tension waves enlarge sometime rising to destructive levels. In the instance of long precast piles special handling is required so that when being lofted the pile does not crack as it deflects. This requires two and sometimes three-point lifts to mitigate the bending stresses. Once positioned in the pile driver leads a long precast pile must be supported, usually by a travelling trolley, at one or more intermediate locations along its length to prevent buckling. While there are remedies for each of these hazards they come at a cost. If the pile cracks or crushes below ground during driving the damage may remain undetected. If the length of pile selected does not achieve the required resistance then it must be abandoned or spliced. The fixture required to construct a precast pile splice is expensive and the assembly labor intensive. While the splice is being constructed the pile driver is idled. When the splice is completed the pile driver resumes and completes the driving. If a precast pile achieves the required resistance and a portion extends above the required cut-off elevation, which typically occurs, the pile must be cut. This requires a special cutting tool, suitable equipment to hold, remove, and transport the wasted section of pile to a disposal site.

Smooth-walled pipe piles are customarily filled with concrete after achieving the specified resistance. One characteristic that determines a pile's ultimate load bearing capacity is its stiffness. Stiffness is a function of the engineering properties, the material from which it is made, which include the weight of that material. It follows that when considering the use of pipe piles the dynamic stresses which occur during driving must be predicted so that the driving energy does not damage the pile. As the stiffness increases, drive time decreases and deeper penetration is achievable with correlating increased ultimate bearing capacity. Another consideration is the length of the pile. Since a pile behaves like a stiff spring, the longer the pile, the larger the amount of useful energy is dissipated as it the travels down through the pile to the tip. The stiffer the pile, the greater the useful energy that is delivered to the tip. It follows that in order to obtain high capacities with tolerable driving time the weight per foot of the pipe must be increased by enlarging the diameter, wall thickness, or both. Lead time is required to obtain pipe piles in quantity, and the same limitations exist as with any preordered length material. The ordered lengths may be too short and require splicing, or, too long and yield excessive waste.

Grout piles are constructed either by drilling through incompetent soils and into the bearing stratum with a hollow stem auger. As the auger is extracted, grout is pumped through the hollow stem to fill the cavity. An alternative method is to advance a closed casing into the competent soils and dump grout into the casing prior to, or as the casing is extracted. The depth of the grout pile is extrapolated from tests at unique locations. Thus, unanticipated variations between these soil strata cannot be identified given the method of installation. This can result in piles of excessive length, or piles of insufficient length. Impact driven piles rely on the observed penetration per hammer blow to confirm the adequacy of the depth of penetration. It is seldom that two impact driven piles in the same region drive to identical depths. As the auger or casing is extracted the grout column may form an unidentifiable profile. The grout column as it is being formed flows outward in soft material such as organic silt, or peat, or in the alternative sensitive clays that have restorative expansive characteristics may apply pressure to the grout column causing a detrimental reduction in diameter. If the pump pressure is inadvertently reduced, or the extraction of the auger or casing too rapid, the grout column may narrow, or be discontinuous. These shaft diameter anomalies may be undetected. The depth of grout piles is limited by the torque of the motor that drives the auger, or the pulling capacity of the rig that installs auger or casing.

Given the above, a need exists for improved and more efficient bearing piles in which structural integrity can be confirmed prior to concreting.

Bearing Piles

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

Bearing piles generally include an elongate member with a lower end that is driven into a subsoil and an upper end that directly or indirectly connects with a foundation of a structure. In certain bearing piles, straight-wall pipes or shells are driven into the subsoil. These bearing piles have certain limitations that are overcome or otherwise improved upon using the corrugated bearing piles installed according to the present disclosure.

FIG. 1 illustrates a cross-section of an in-situ corrugated bearing pile 100. The bearing pile 100 can be installed to a bearing depth within a subsoil 110. The bearing pile 100 can include a first corrugated shell 20. The first corrugated shell 20 can be formed of a corrugated steel pipe. The corrugated shell 20 can have a first end 21. The first end 21 can be a lower end within the subsoil 110. The first end 21 can be at a bearing depth of the bearing pile 100.

The corrugated shell 20 can have a second end 22. The second end 22 can be an upper end within the subsoil 110. The corrugated shell 20 can have a length 20*a*. The length 20*a* can extend from the first end 21 to the second end 22. The corrugated shell 20 can have an outer diameter 20*b*. The diameter 20*b* can be uniform from the first end 21 to the second end 22, although this is not required. The corrugated shell 20 can include a plurality of corrugations 23.

The corrugated shell 20 (or any other corrugated shell describe herein) can be formed of a thin-walled corrugated pipe. The thin-walled corrugated pipe can comprise steel. The steel can be a carbon steel, galvanized steel, stainless steel and/or other alloy, grade, and/or type of steel. The steel can have a thickness between 7 and 28 gauge (0.1793 inches (4.554 mm) and 0.0149 inches (0.378 mm)). In certain implementations, the steel can have a thickness of 8, 10, 12, 14, 16, or 18 gauge. The corrugated steel pipe can include a plurality of helical flutes (e.g., corrugations 23). The corrugations 23 can have any suitable profile such as, but not limited to standard width/depth profiles (in inches): 2×½, 1½×⅜, 1⅝×5/16, 1¼×¼, and 1¼×5/16. In certain implementations, the corrugations 23 can include a helix angle between approximately 4 and 45 degrees. In certain implementations, the corrugations 23 can include a pitch distance (e.g., crest to crest) between approximately 1 inch and 5 inches. In certain implementations, the corrugations 23 can include a flute depth between approximately ¼ inch and 1 inch. Each of the above dimensions is considered to be illustrative and not limiting. Alternatively, the plurality of corrugations can be circumferential instead of helical. In another aspect, the length of the first corrugated shell is up to 90 feet and the length of the second corrugated shell is up to 90 feet. In another aspect, the corrugations of the first and second corrugated shells have a helix angle between about 4 and 45 degrees. In another aspect, the corrugations of the first and second corrugated shells have a pitch distance (crest to crest) of between about ¼ inches and 6 inches. In another aspect, the corrugations of the first and second corrugated shells have a flute depth between about ¼ and 3 inches. In another aspect, the first and second corrugated shells have a thickness between about 0.03 inches and ¼ inches. In another aspect, the first and second corrugated shells each have a diameter between about 6 inches and 36 inches.

The bearing pile 100 can include a second corrugated shell 30. The corrugated shell 30 can be formed of a corrugated steel pipe. The corrugated shell 30 can include a first end 31. The first end 31 can be a lower end of the corrugated shell 30. The corrugated shell 30 can include a second end 32. The second end 32 can be an upper end of the corrugated shell 30. The second end 32 of the second of the second corrugated shell 30 can be aligned above or at a top surface of the subsoil 110. In certain implementations, the second end 32 can extend above the topsoil 10. The corrugated shell 30 can have a length 30*a*. The length 30*a* can extend from the first end 31 to the second end 32. The corrugated shell 30 can have an outer diameter 30*b*. The diameter 30*b* can be uniform from the first end 31 to the second end 32, although this is not required. The corrugated shell 30 can include a plurality of corrugations 33.

The first corrugated shell 20 can be attached with the second corrugated shell 30. The corrugated shell 30 can be longitudinally aligned with the corrugated shell 20. The first end 31 of the corrugated shell 30 can be attached directly or indirectly with the second end 22 of the corrugated shell 20. A coupler 50 can be located at then interface between the corrugated shells 20, 30. The coupler 50 can attach with the second end 22 and/or the first end 31.

The coupler 50 can include a band or outer rim. The outer rim can define a lower end 51 and an upper end 52 of the coupler 50. The coupler 50 can include a plate or central portion 53. The central portion 53 can be a steel plate. A rim of the first end 31 can abut the central portion 53 from the upper end 52. A rim of the second end 22 can abut the central portion 53 from the lower end 51. The central portion 53 can span the interface between the first end 31 and the second end 22. The central portion 53 can be solid (e.g., fully spanning the diameters of both the first and second ends 31, 22) or at least partially span the first and second ends 31, 22 (e.g., including one or more apertures therethrough). Alternatively, the central portion 53 can be an inner circumferential rim. The rims of the first and second ends 31, 22 can abut the inner circumferential rim. Alternatively, the rims of the second end 22 can directly abut the first end 31 (e.g., without the central portion 53).

The central portion 53 can be formed as a single piece with the outer rim (e.g., by welding). Alternatively, the central portion 53 can be a separate component of the coupler 50 from the outer rim. The outer rim can be a helical splicer. The outer rim can optionally be reinforced with welded straps or bands for added strength during driving.

The lower end 51 can receive the second end 22. The lower end 51 can include a plurality of threads. The threads can have a slightly larger or smaller diameter than the diameter 20*b* of the second end 22. Accordingly, one or more of the corrugations 23 of the second end 22 can be engaged with the threads of the lower portion 51.

The upper end 52 can receive the first end 31. The upper end 52 can include a plurality of threads. The threads can have a slightly larger or smaller diameter than the diameter 30*b* of the first end 31. Accordingly, one or more of the corrugations 33 can be engaged with the plurality of corrugations of the upper end 52 of the coupler 50. Alternatively, the upper and/or lower ends 51, 52 do not include the plurality of threads. The first end 31 and/or the second end 21 can be received within the respective upper and lower ends 51, 52. The ends can be crimped, welded, clamped or otherwise attached with each other.

In another alternative, the first and second ends 31, 22 can be coupled together directly (e.g., without the coupler 50). In certain implementations, the first and second ends 31, 22 can be welded together. In certain implementations, the first and second ends 31, 22 can be banded together by one or more bands (e.g., without the central portion 53). In certain implementations, the corrugations of the first and second ends 31, 22 can be directly threaded together. In certain implementations, any of the above mechanical fastenings can be combined (e.g., engagement within the coupler 50 and welding).

A cap 40 can attach with the first end 21 of the corrugated shell 20. The cap (boot plate) 40 can be attached with the first end 21 in a permanent or removable fashion. The cap 40 can include an outer rim. The first end 21 can be received within the outer rim. The outer rim can include a plurality of threads. The threads can have a slightly larger or smaller diameter than the diameter 20*b* of the first end 21. Accordingly, the cap 40 can be engaged with the first end 21. The cap 40 can include a central portion 41. The central portion 41 can at least partially or fully enclose the first end 21 of the corrugated shell 20. The central portion 41 can be domed, pointed, or flat. The cap 40 can be a boot plate. The outer rim can be a helical splicer. The outer rim can optionally be reinforced with welded straps or bands. Alternatively or in addition to the threads, the cap 40 can be otherwise mechanically attached (e.g., welded) with the first end 21. Alternatively or in addition, the first end 21 can include a cement plug. The cement plug can be external and/or internal to the corrugated shell 20.

The corrugated shell 20 can include an interior space. The interior space can be filled with a filler material 61. The filler material 61 can extend from the first end 21 to the second end 22 or otherwise fill or substantially fill the interior space. The filler material 61 can extend from the cap 40 to the coupler 50. The filler material 61 can comprise a cured concrete containing cement, sand aggregate, grout containing cement and sand, and/or any other material. The corrugated shell 30 can include an interior space. The interior space can be filled with a filler material 62. The filler material 62 can extend from the first end 31 to the second end 32 or otherwise fill or substantially fill the interior space. The filler material 62 can extend from the coupler 50 to the second end 32. The filler material 62 can be the same as the filler material 61. The filler material 62 can comprise a cured cement or soil, aggregate, sand and/or any other material. Optionally, the central portion 53 of the coupler 50 can separate, or at least partially separate, the filler material 62 from the filler material 61.

The bearing pile 100 can be installed within a subsoil 110. The subsoil 110 can comprise various soil components and/or layers. The subsoil 110 can include miscellaneous fill, silt, peat, sand, gravel, rocks, boulders, bedrock, etc. or any combinations thereof. The subsoil 110 can comprise rocks and/or rock stratum. The bearing pile 100 can extend through the various layers of the subsoil 110. The bearing pile 100 can contact and rest on the rock stratum.

In certain implementations, the subsoil 110 is located in a river delta or alluvial deposition (e.g., comprising layers of deposited silt) or other location lacking a rock stratum (e.g., bedrock). Accordingly, the subsoil 110 may be a challenging location for building large structures requiring high loading capacities; substantially the entire loading requirements of the structure must be borne by the bearing piles. Moreover, reducing the total number of bearing pilings can have cost-savings advantages. Increasing the total loading capacity of each piling can therefore have cost and labor saving improvements.

In certain implementations, (e.g., river deltas) the depth of rock stratum and/or the soil properties can require deep bearing depths to provide the desired loading capacity. In certain examples, the bearing pile 100 can have a bearing depth that ranges up to 300 feet.

The bearing depth of the bearing pile 100 can be varied to provide the desired loading capacity. Deeper bearing depths can increase the loading capacity. In certain implementations, the lengths 20*a*, 30*a* can be varied to achieve the desired bearing depth. In certain implementations, the bearing depths can be selected such that one or more of the corrugated shells 20, 30 are located within a bearing stratum of the subsoil 110. The bearing stratum can have soil properties that provide additional support to the bearing pile 100 (e.g., relative to adjacent soil stratum). In certain implementations, the bearing pile 100 includes additional corrugated shells. For example, the bearing pile 100 can include 3, 4, 5, 6, 7 or more connected corrugated shells. The corrugated shells 20, 30 can be representative of each of the additional corrugated shells. The coupling between the corrugated shells 20, 30 can also be representative of connections between the additional corrugated shells. Accordingly, the bearing depth of the bearing pile 100 can be adjusted by the addition of more or fewer corrugated shells and/or couplers.

The corrugated shell in the bearing stratum may have a diameter which is lesser, equal, or greater than the corrugated shell above the bearing stratum. A larger diameter corrugated shell in the bearing stratum is advantageous in that the bearing pile will drive to a lesser depth because the two contributing components to the ultimate bearing capacity are dependent on the surface area and the tip areas of the bearing pile. The diameter of corrugated shell above the bearing stratum must be of sufficient area to transmit the load from the new structure down into the bearing stratum. This may permit any portions of the bearing pile 100 to have a diameter less than the diameter of portions of the pile embedded in the bearing stratum. Smaller diameter corrugated shells can reduce the overall material cost of the bearing pile 100.

The diameters of the corrugated shells (e.g., diameter 30*b* diameter 20*b*, and/or diameters of any other corrugated shells) of the bearing pile 100 can be varied to provide the desired loading capacity and driving properties. Larger diameters can increase the loading capacity. In certain implementations, the diameters can be, but are not required to be: up to 36 inches; between approximately 6 inches and 36 inches. These values can represent nominal dimensions of the corrugated shells.

Certain other bearing pile configurations include smooth-walled pipes or shells embedded within a subsoil. The structure of the bearing pile 100, in contrast, provides an enhanced loading capacity relative to these configurations. Detail view 1A shows a representative section of an interface I of the corrugated shell 20 (or corrugated shell 30) with the subsoil 110. A shear force between the corrugated shell 20 and the subsoil 110 acts along the interface I and is parallel to the bearing pile 100 (e.g., oriented along a longitudinal axis of the corrugated shell 20). The total aggregate shear force acting over the outer surface of the bearing pile 100 can determine the loading capacity of the bearing pile 100 (e.g., in addition to any supported provided by soil against the cap 40).

The corrugations 23 of the corrugated shell 20 can include a first crest 23*a*, second crest 23*b*, a third crest 23*c*, a first valley 23*d* and a second valley 23*e*. Certain soil portions 110*a* of the subsoil 110 can be trapped between the crests 23*a*, 23*b*, 23*c* and generally within the valleys 23*d*, 23*e*, respectively. The trapped soil portions 110*a*, 110*b* create a soil-soil interface between the corrugated shell 20 and the soil 110. In contrast, smooth-walled pipes or shells include a metal-soil interface. The shear force provided by frictional engagement at the soil-soil interface can be much greater than a metal-soil interface. Accordingly, the total loading capacity of the bearing pile 100 can be enhanced through the use of the corrugated steel pipes of the first and second corrugated shells. The friction value at the soil-soil interface can be 50 to 300% greater than the friction value at smooth or straight metal-soil interfaces.

Methods of Improved Bearing Pile Installation

Figure 2:
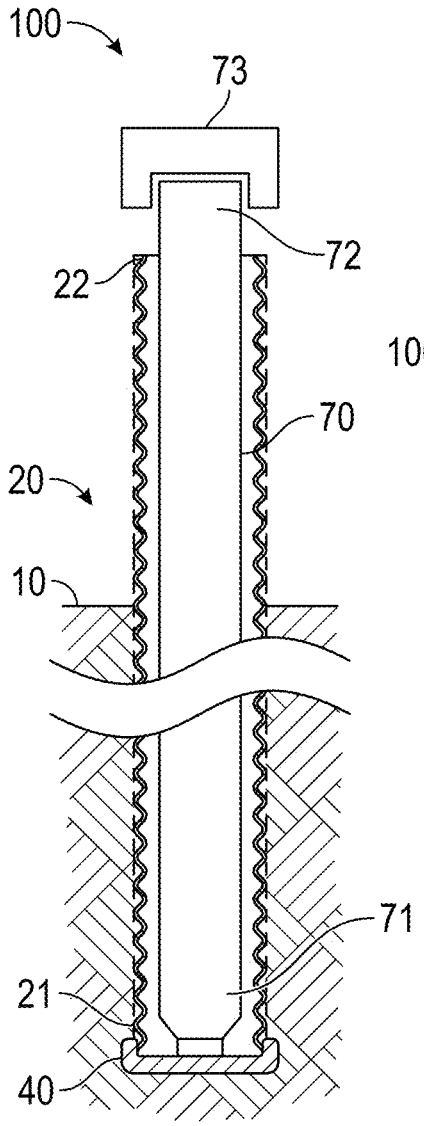
FIG. 2 shows driving the first corrugated shell into the subsoil using a mandrel.

FIGS. 2-7 illustrate a method of installing the bearing pile 100 in the subsoil 110. The corrugated shell 20 can be driven into the subsoil 110 using a mandrel 70 and the cap 40, as shown in FIG. 2. The cap 40 can be attached with the first corrugated shell 20 at the first end 21. The first end 21 can be received within the outer rim of the cap 40. The threads of the cap can be engaged with the corrugations of the first end 21. In some implementations, the cap 40 can be welded or otherwise attached with the first end 21.

The first corrugated shell 20 can be aligned with the subsoil 110. In certain implementations, the corrugated shell 20 can be aligned perpendicular with the subsoil 110 in a generally vertical or battered manner. For example, the shell 20 can be aligned perpendicularly (approximately 90 degrees relative to the plane of the adjacent subsoil). In the case of battered piles, the shell 20 can be aligned at an inclined angle relative to the subsoil 110, as required. To align the corrugated shell 20 with the subsoil 110, the second end 22 can be lifted by a crane (not shown) or other equipment.

The mandrel 70 typically is a steel shaft. The shaft can comprise steel. The shaft can have a diameter smaller than an inner diameter of the corrugated shell 20. The shaft can be longer than the length 20*a* of the corrugated shell 20. The mandrel 70 can include a lower end 71. The lower end 71 can be inserted into the first corrugated shell 20. The lower end 71 of the mandrel 70 can engage with the cap 40. Alternatively, the lower end 71 of the mandrel 70 can engage with the plug within the first end 21. A drive mechanism 73 can engage with the upper end 72 of the mandrel 70. The drive mechanism 73 can be a hammer (pressure or impact) or vibrational (or other type) of driving mechanism. The mandrel 70 and the drive mechanism 73 can be supported by the crane. Advantageously, the lower end 71 can maintain engagement with the cap 40 (e.g., at the central portion 41) during driving. The drive mechanism 73 can drive, vibrate or push the first end of the corrugated shell 20 into the subsoil 110 to a first depth. The first depth can be an elevation at which the corrugated shell 20 maintains structural integrity.

The use of corrugated steel pipe for the corrugated shell 20 offers several improvements over the use of smooth-walled pipes. Generally, smooth-walled pipes can be driven into a subsoil by applying a driving force to an upper end of the smooth-walled pipe with a driver, such as a hammer or vibrational driver. Driving in this manner requires the smooth-walled pipe have sufficient wall thickness (e.g., strength) to withstand the driving forces without significant deformation, especially where the driving forces are applied through an impact. One aspect of the present disclosure is the realization that corrugated shells, such as the corrugated shell 20, may lack the wall thickness to be driven by direct impact without deformation. Accordingly, the mandrel 70 enables the installation.

The corrugations 23 allow for less material to be used, as compared with smooth-walled pipes. For a given wall thickness, corrugated steel shells have a greater crush resistance and bending resistance than smooth-walled pipes made of steel. To achieve the same crush resistance, smooth-walled pipes would require thicker walls. This additional material increases the total weight and cost of the smooth-walled pipes. Accordingly, the use of corrugated shells offers a substantial weight and cost savings. The rate and depth of penetration are a function of the stiffness of a pile. Stiffness has two components; the type of material and the weight per foot of the material. As an example, in the present disclosure the weight per foot of a 14 inch diameter corrugated shell, concrete filled, is approximately 170 pounds per foot. The mandrel which subsequently drives the first section can be constructed to weigh approximately 200 pounds per foot. 14 inch diameter steel pipe piles typically selected as an alternative range from 0.5 inches to 1 inch wall thickness weighing 75 pounds to 140 pounds per foot cannot be driven as rapidly or achieve the deeper penetration when required. Smooth walled pipe is approximately 3 to 5 times more expensive than the corrugated pipe.

There are various subsoil conditions worldwide and even within local subsoil profiles. To illustrate another example of many possible scenarios for a given subsoil example, a material and installation savings example is hereby provided. To achieve a 100 ton design load (200 ton ultimate capacity using a safety factor of 2) pile, a 14 inch diameter corrugated shell can obtain capacity at a penetration depth of 100 feet (due to higher friction capacity—corrugations providing significant soil-soil interlocking friction) while a 14 inch diameter×0.375 inch smooth wall steel pipe may require deeper penetration of approximately 120 feet to achieve the same capacity (due to minimal smooth wall metal-soil friction capacity requiring more tip penetration). The potential savings are estimated as follows. The amount of steel required for the 14 inch diameter×0.375 inch×120 foot smooth wall steel pipe is as follows: 54 pounds per foot×120 feet=6,480 pounds of steel=3.24 tons. The amount of steel required for a 14 inch diameter corrugated steel shell×100 foot is as follows: 18 pounds per foot×100 feet=1,800 pounds of steel=0.9 tons. Accordingly, the corrugated steel shell saves 72% (Steel savings={3.24 tons−0.9 tons}/3.24 tons=72%). The 14 inch diameter×0.375 inch×120 feet length smooth wall steel pipe requires 4.2 cubic yards of concrete fill. The 14 inch diameter corrugated steel shell (embodiment)×100 foot requires 3.5 cubic yards of concrete fill. Accordingly, concrete savings are 16% ({4.2 cubic yards−3.5 cubic yards}/4.2 cubic yards=16%). The 14 inch diameter corrugated steel pipe×100 foot will reduce installation time by approximately 20% or more. The corrugated steel shell (embodiment) potentially saves 72% of steel material, 16% of concrete filler material and 20% installation time.

Another aspect of the present disclosure is the realization that a subsoil exerts radially inward forces on the smooth-walled pipes as they are driven into the subsoil and at the first depth. The driving forces from a driver can also cause compression waves through the smooth-walled pipes. The radially inward forces from the subsoil and/or compression from the driving forces can cause the smooth-walled pipes to fail (e.g., deform) during the driving, either with or without a mandrel. In contrast, the corrugations 23 in the corrugated shell 20 act to provide an enhanced crush resistance to the radially inward force and compression waves from driving. The corrugations 23 accordingly provide better resistance to deformation of the corrugated shell 20 both during driving and at depth.

Figure 3:
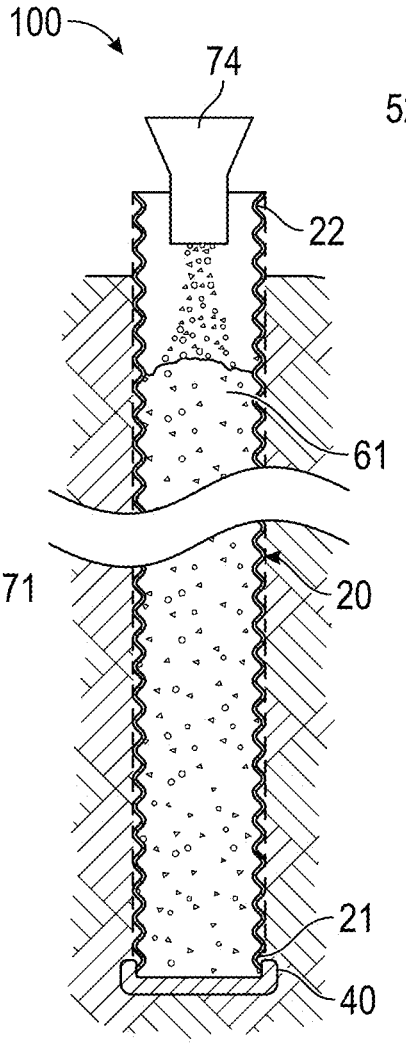
FIG. 3 shows filling the first corrugated shell with a filler material.

FIG. 3 shows the corrugated shell 20 installed to the first depth within the subsoil 110. The second end 22 can be above the top surface of the subsoil 110. For example, the second end 22 can be between approximately 6 inches and 36 inches (or in some instances higher) above the top surface of the subsoil 110. The corrugated shell 20 can be filled with the filler material 61 in a flowable form. A nozzle 74 can align with the second end 22 to insert the filler material 61. The filler material 61 can comprise concrete. The filler material 61 can fill the entirety of the first corrugated shell 20 from the first end 21 to the second end 22, or substantially all of the length thereof. The filler material 61 can then be cured. The filler material 61 can cure to a sufficient compressive strength. The curing process occurs over a period of time. At the first depth, the corrugated shell 20 can be visually internally inspected for structural integrity before filling with the filler material 61.

Figure 4:
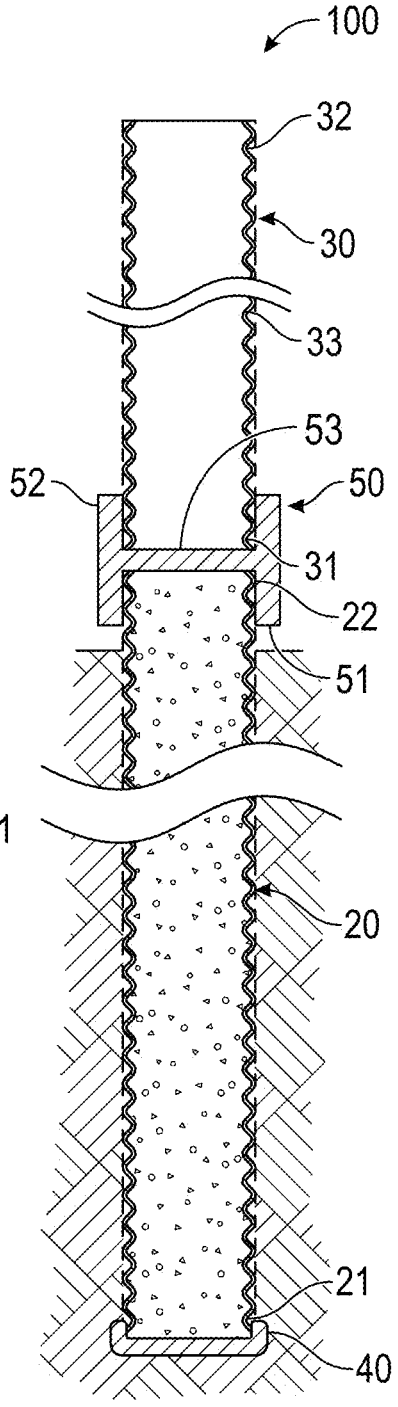
FIG. 4 shows attaching the second corrugated shell with the first corrugated shell.

In FIG. 4, the coupler 50 can be attached with the second end 22. For example, the second end 22 can be received within the lower end 51 of the coupler 50. The threads of the lower end 51 can be engaged with the corrugations of the second end 22 and/or the coupler 50 can be otherwise mechanically engaged with the second end 22. The second end 22 can abut the central portion 53 of the coupler 50.

The second corrugated pipe shell 30 can be aligned with first corrugated shell 20. The second corrugated shell 30 can be aligned along the axis of the first corrugated shell 20. The first end 31 can be received within the upper end 52 of the coupler 50. The corrugations of the first end 31 can be engaged with threads of the upper end 52 and/or the coupler 50 can be otherwise mechanically engaged with the first end 31. The first end 31 can abut the central portion 53 of the coupler 50. Optionally, the first end 31 and/or second end 22 can be welded to the coupler 50.

Alternatively or in addition to the coupler 50, the second end 22 can be welded, banded other otherwise attached with the first end 31. In another implementation, the fluting of the second corrugated shell 30 can be engaged over the fluting of the first corrugated shell 20, or vice versa.

Figure 5:
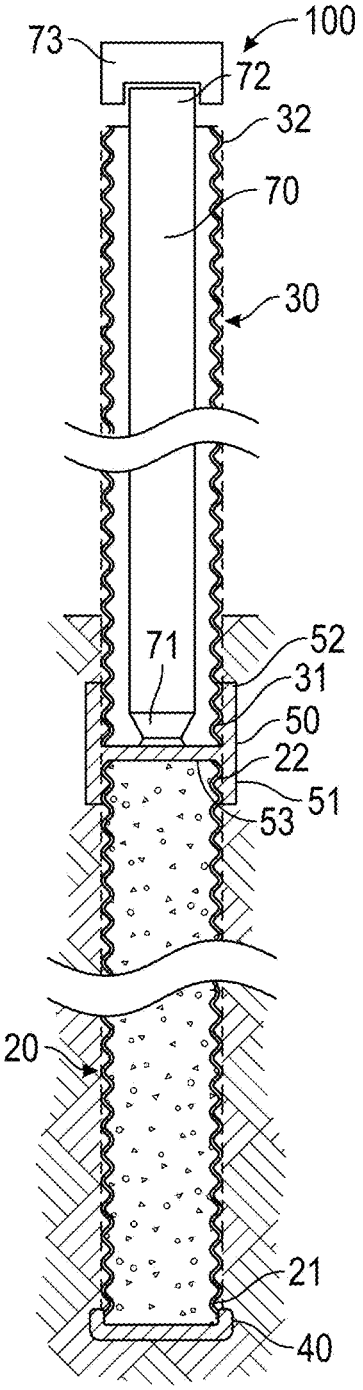
FIG. 5 shows driving the first and second corrugated shells deeper into the subsoil using the mandrel.

As shown in FIG. 5, the mandrel 70 can be inserted into the second corrugated shell 30. The lower end 71 can engage the central portion 53 of the coupler 50. In other implementations, the lower end 71 can engage the filler material 61 of the corrugated shell 20. In other implementations, the lower end 71 of the mandrel 70 can engage with a plug or other component within the first end 31. The upper end 72 of the mandrel 70 can be driven using the drive mechanism 73. The driving forces from the drive mechanism 73 can be transmitted from the mandrel 70 into the first end 31, thus protecting the corrugated shell 30 thereby maintaining structural integrity.

Figure 6:
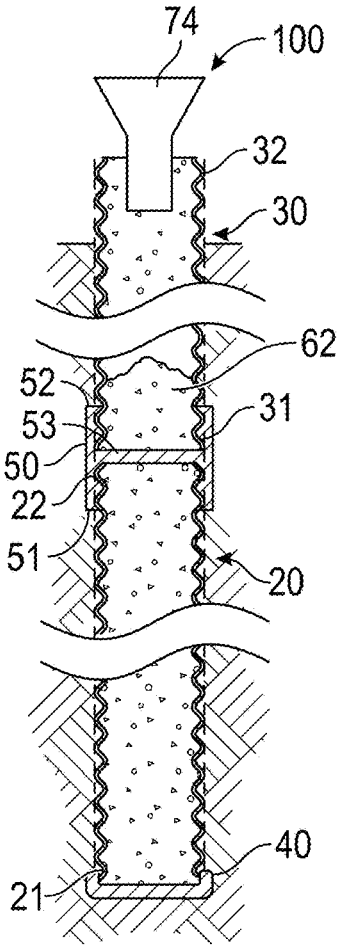
FIG. 6 shows filling the second corrugated shell with the filler material.

The driving forces through the mandrel 70 can drive the first and second corrugated shells 20,30 to a second depth, as shown in FIG. 6. At the second depth, the second end 32 can be above, below, or level with the top surface of the subsoil 110. At the second depth, the filler material 62 can be added to the second corrugated shell 30 in a flowable state. The filler material 62 can fill the corrugated shell 30 from the first end 31 to the second end 32. The filler material 62 be allowed to cure into a solid state.

Figure 7:
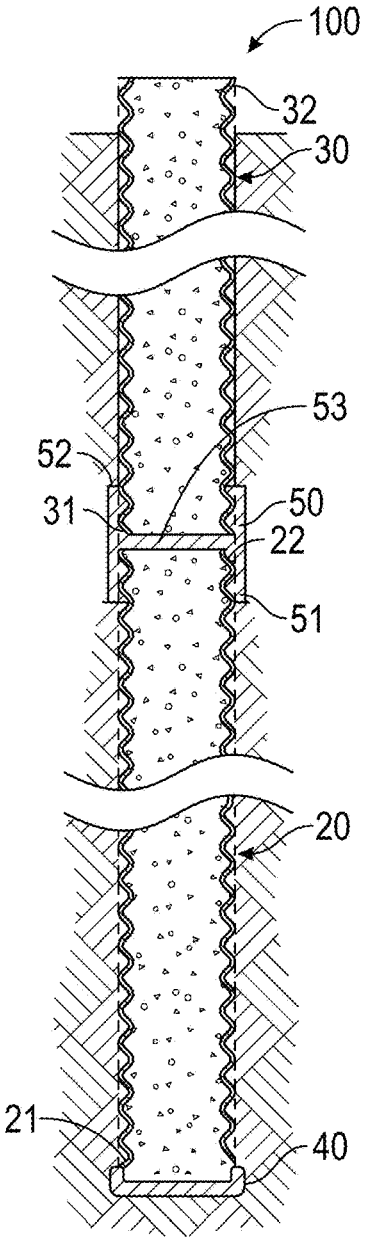
FIG. 7 shows the finished bearing pile at bearing depth.

In FIG. 7, the bearing pile 100 is shown installed to the bearing depth. The bearing depth to achieve a desired loading capacity for a subsoil can vary for each piling. More or less total length may be used to achieve the desired loading capacity. Optionally, additionally corrugated shells can be added to the bearing pile 100 by repeating the above steps shown and described in relation to FIGS. 4-6. Accordingly, any desired bearing depth and loading capacity can be reached by attaching and driving additional corrugated shells, segment-by-segment to the bearing pile 100. The ability to change the bearing depth of the bearing pile 100 on short notice results in reduced waste material. For example, excess corrugated shell length that extends above the ground surface can be cut off. Alternatively, additional corrugated shell lengths can be added to bearing pile 100. The segment-by-segment installation methodology makes the bearing pile 100 highly versatile.

In certain implementations, multiple bearing piles 100 can be installed at a building site. The bearing piles 100 can be laid out in a grid pattern (e.g., square, rectangular, circular or hexagonal) or unique project-specific pattern. The quantity of and layout of piles is determined by load parameters and structural dimensions.

As the total length of the bearing pile 100 increases, transferring the driving forces from the upper end through the lower end becomes more difficult. The lengthening bearing pile 100 and the resistance to driving provided by the subsoil 110 can result in a lack of impedance match between the drive mechanism 73 and the bearing pile 100. The bearing pile 100 can act more like a spring and absorb the driving forces and/or reflect them back to the drive mechanism 73. Filling the corrugated shell 20 with the filler material 61, filling the corrugated shell 30 with the filler material 62, and repeating this process for any additional corrugated shell lengths improves the driving properties of the bearing pile 100. Accordingly, the improved stiffness of the bearing pile 100 results in faster driving times.

The corrugated shells of the bearing pile 100 can be formed of any total length (e.g., up to 300 feet). In one implementation, two approximately 70 foot corrugated shells in the bearing pile 100 are installed sequentially, each section of such length as to satisfy equipment and soil parameters. The practical working length for a mandrel is typically equal to or less than 90 feet. Accordingly, installation of a single shell longer than 90 feet would be highly impractical, whereas installation of two or more shorter (90 feet or less) corrugated shells is highly practical using the methods of the present disclosure.

Different lengths for the corrugated shells of the bearing pile 100 can also be used. For example, to reach 150 foot bearing depth, three 50 foot corrugated shells can be used. Configurations comprising a series of specific lengths of corrugated shells can be furnished to provide the precise total lengths required thereby optimizing material and labor costs. For example, a configuration comprising two—50 foot corrugated shells and one—40 foot corrugated shell can be utilized for a 140 foot total length pile. As another example, a configuration comprising two—60 foot corrugated shells and one—50 foot corrugated shell can be utilized for a 170 foot total length pile. The nominal length of each corrugated shell (20, 30 or others) can range from 10 feet to 90 feet. The shells do not need to be the same length. Also because of the low stresses placed on the corrugated shells during the driving process by using the mandrel, each of the driven corrugated shells in the bearing pile 100 can comprise multiple different connected corrugated shell segments or single lengths of corrugated shell. Accordingly, the diameter of the corrugated shells in the pile 100 can be varied, as explained further below.

Bearing Pile Variations

Figure 9:
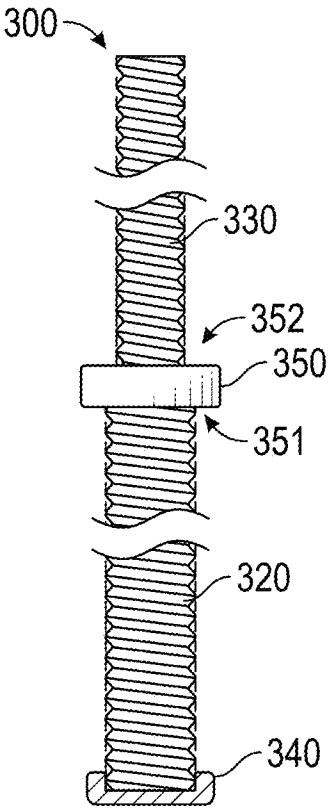
FIG. 9 shows upper and lower corrugated shells attached together by a coupler, the lower corrugated shell having a diameter greater than a diameter of the upper corrugated shell.
Figure 8:
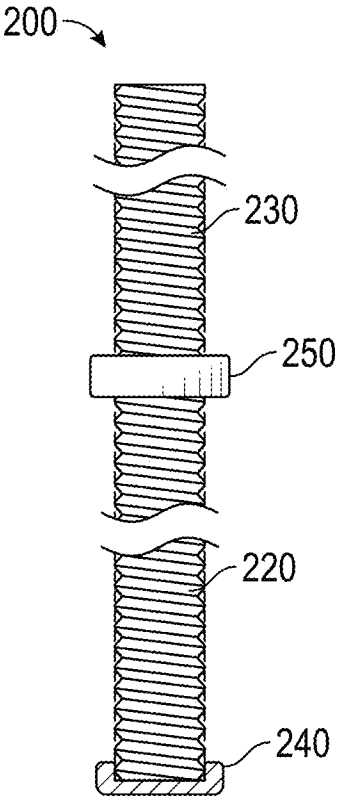
FIG. 8 shows upper and lower corrugated shells attached together by a coupler.

FIG. 8 illustrates another implementation of a bearing pile 200 comprising first and second corrugated shells 220, 230 connected together by a coupler 250. A cap 240 can be connected with a lower end of the first corrugated shell 220. The first corrugated shell 220 can have a first outer diameter. The second corrugated shell 230 can have a second outer diameter. The first and second outer diameters can be approximately equal. For example, the diameters can be between 6 inches and 36 inches. The second outer diameter is desirably great enough to transmit the load from the structure to the lower portion of the pile embedded in the bearing stratum FIG. 9 illustrates another implementation of a bearing pile 300 comprising a first corrugated shell 320 and a second corrugated shell 330 coupled together by a coupler 350. A cap 340 can attach with the first corrugated shell 320. The first corrugated shell 320 can have a first outer diameter. The second corrugated shell 330 can have a second outer diameter. The second outer diameter can be less than the first outer diameter. The coupler 350 can include a central plate. The coupler 350 can include a lower end 351 and an upper end 352. The lower end 351 can be sized to receive the first outer diameter (e.g., within an outer rim). The upper end 352 can be sized to receive the second outer diameter (e.g., within an outer rim).

As the upper strata subsoil 110 settles around the bearing pile 300, the subsoil can exert a downdrag force on the bearing pile. Accordingly, the bearing pile 300 can settle below the bearing depth, which is undesirable. Also known as negative skin friction, the downdrag force is proportional to the total surface area of the corrugated shells embedded in the consolidating soil layers. Accordingly, by reducing the surface area of the second corrugated shell 330 by using a smaller second outer diameter, the total downdrag force can be reduced. Advantageously, the smaller second diameter can prevent downdrag settlement of the bearing pile 300. In certain implementations, the corrugated shells having reduced diameters can be located above the bearing stratum within the subsoil 110. The larger first diameter 340 has the advantage of a greater capacity per foot of embodiment in the bearing stratum resulting in a shorter pile with less driving time.

Figure 10:
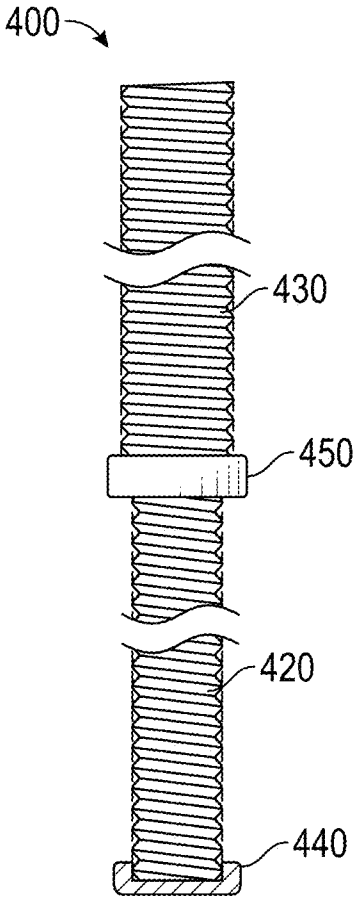
FIG. 10 shows upper and lower corrugated shells attached together by a coupler, the upper corrugated shell having a diameter greater than a diameter of the lower corrugated shell.

FIG. 10 illustrates another implementation of a bearing pile 400. The bearing pile 400 can comprise a first corrugated shell 420 and a second corrugated shell 430 connected by a coupler 450. A cap 440 can attach with an end of the first corrugated shell 420. The first corrugated shell 420 has a first outer diameter that is less than a second outer diameter of the second corrugated shell 430. The coupler 550 can include a central plate. The coupler 450 can include a lower end and an upper end. The lower end can be sized to receive the first outer diameter (e.g., within an outer rim). The upper end can be sized to receive the second outer diameter (e.g., within an outer rim). The larger second (outer) diameter corrugated shell 430 is advantageous when the pile is subjected to shear or bending stresses (e.g., lateral loads) that dissipate with depth. The larger pile diameter is only required in the upper portion of the pile.

Figure 11:
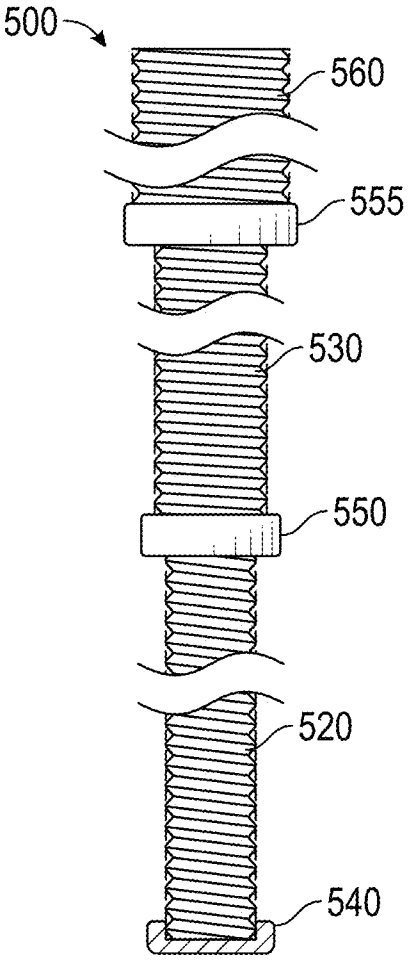
FIG. 11 shows three corrugated shells attached together by a first coupler and a second coupler.

FIG. 11 illustrates another implementation of a bearing pile 500. The bearing pile 500 can include a first corrugated shell 520, a second corrugated shell 530, and a third corrugated shell 560. A cap 540 can be attached to the first corrugated shell 520. The first and second corrugated shells 520, 530 can be connected with a first coupler 550. The second corrugated shell 530 and the third corrugated shell 560 can be connected by a second coupler 555. The first and second corrugated shells 520, 530 can have approximately the same diameter. The second corrugated shell 530 can have a diameter less than a diameter of the third corrugated shell 560. The second coupler 555 can accommodate the differences in the diameters between the second corrugated shell 530 and the third corrugated shell 560. Alternatively, the first corrugated shell 520 can have a larger or smaller diameter than the second corrugated shell 530.

Figures 12, 13, 14, 15:
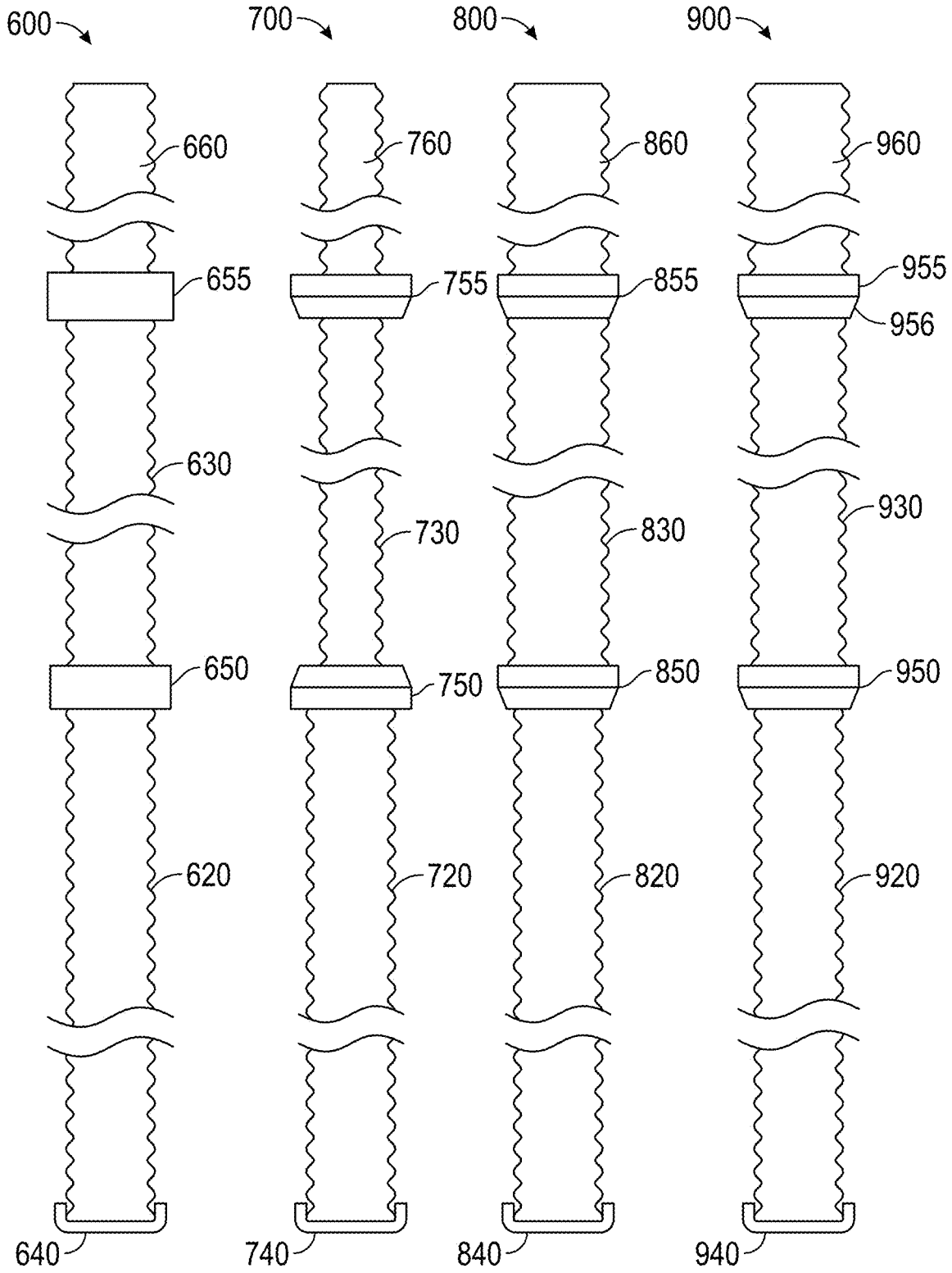
FIG. 12 shows three corrugated shells attached together by a first coupler and a second coupler in another variation of a bearing pile.
FIG. 13 shows three corrugated shells attached together by a first coupler and a second coupler in another variation of a bearing pile.
FIG. 14 shows three corrugated shells attached together by a first coupler and a second coupler in another variation of a bearing pile.
FIG. 15 shows three corrugated shells attached together by a first coupler and a second coupler in another variation of a bearing pile.

FIG. 12 shows another implementation of a bearing pile 600. The bearing pile 600 can include a plurality of corrugated shells connected together by couplers. The bearing pile 600 can include first, second, and third corrugated shells, 620, 630, 660 connected together by respective first and second couplers 650, 655, and/or an end cap 640 attached with the first corrugated shell 620. The first corrugated shell 620 can have a first outer diameter. The second corrugated shell 630 can have a second outer diameter. The third corrugated shell 660 can include a third diameter. The first and second outer diameters can be the same or approximately the same. The second and third diameters can be the same or approximately the same.

FIG. 13 shows another implementation of a bearing pile 700. The bearing pile 700 can include a plurality of corrugated shells connected together by couplers. The bearing pile 700 can include a first, second, and third corrugated shells, 720, 730, 760 connected together by respective first and second couplers 750, 755, and/or an end cap 740 attached with the first corrugated shell 720. The first corrugated shell 720 can have a first outer diameter. The second corrugated shell 730 can have a second outer diameter. The third corrugated shell 760 can include a third diameter. The third and second outer diameters can be the same or substantially the same. The second and third diameters can be less than the first outer diameter. The first coupler 750 can accommodate the differences in diameters.

In certain implementations, the wall thickness (e.g., gauge) of the second corrugated shell 730 and/or the third corrugated shell 760 can be less than the wall thickness of the first corrugated shell 720. Lateral pressure of the soil increases with depth, therefore the pressure on the upper corrugated shells is less than the pressure on the lower corrugated shells. Because of the reduced second and third diameter, the pressure from the subsoil is reduced, allowing a less rigid (lighter gauge) shell.

FIG. 14 shows another implementation of a bearing pile 800. The bearing pile 800 can include a plurality of corrugated shells connected together by couplers. The bearing pile 800 can include a first, second, and third corrugated shells, 820, 830, 860 connected together by respective first and second couplers 850, 855, and/or an end cap 840 attached with the first corrugated shell 820. The first corrugated shell 820 can have a first outer diameter. The second corrugated shell 830 can have a second outer diameter. The third corrugated shell 860 can include a third diameter. The third and second outer diameters can be the same or substantially the same. The second and third diameters can be greater than the first outer diameter. The first coupler 850 can accommodate the differences in diameters.

FIG. 15 shows another implementation of a bearing pile 900. The bearing pile 900 can include a plurality of corrugated shells connected together by couplers. The bearing pile 900 can include a first, second, and third corrugated shells, 920, 930, 960 connected together by respective first and second couplers 950, 955, and/or an end cap 940 attached with the first corrugated shell 920. The first corrugated shell 920 can have a first outer diameter. The second corrugated shell 930 can have a second outer diameter. The third corrugated shell 960 can include a third outer diameter. The third diameter can be greater than the second outer diameter. The second outer diameter can be greater than the first outer diameter. The first and second couplers 950, 955 can accommodate the differences in diameters.

Figure 16:
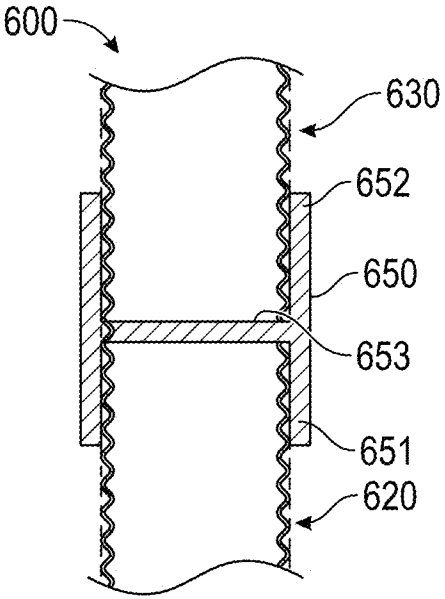
FIG. 16 shows a cross-section of the first coupler of FIG. 12.

FIG. 16 shows a detailed cross-section of the coupler 650 of FIG. 12. The coupler 650 has a lower end 651. The lower end 651 can be defined by an outer rim. The outer rim can be circular or another shape. The outer rim can include a plurality of internal threads. The internal threads can be sized to engage with corrugations of the second corrugated shell 620. The coupler 650 can include an upper end 652. The upper end 652 can include an outer rim. The outer rim can be circular or another shape. The outer rim can include a plurality of internal threads. The internal threads can engage with corrugations of the second corrugated shell 630. The first corrugated shell 620 and/or the second corrugated shell 630 can be welded or otherwise mechanically fastened with the coupler 650. Alternatively, the coupler 650 does not include internal threads and the first corrugated shell 620 and/or the second corrugated shell 630 are welded or otherwise mechanically fastened with the coupler 650.

The coupler 650 can include a plate or central portion 653. The central portion 653 can entirely or partially span between the outer rims of the upper and lower ends 651, 652. In certain implementations, the central portion 653 can include one or more apertures and/or other openings therethrough. The first corrugated shell 620 can abut the central portion 653. The second corrugated shell 630 can abut the central portion 653. In certain implementations, the corrugated shell 620 and/or 630 can be welded with the central portion 653.

Figure 17:
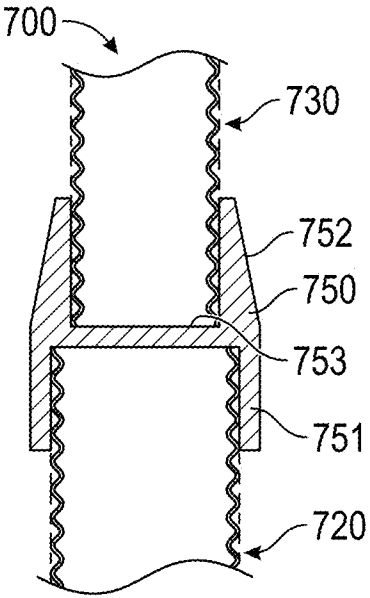
FIG. 17 shows a cross-section of the first coupler of FIG. 13.

FIG. 17 shows a detailed cross-section of the coupler 750 of FIG. 13. The coupler 750 has a lower end 751. The lower end 751 can be defined by an outer rim. The outer rim can be circular or another shape. The outer rim can include a plurality of internal threads. The internal threads can be sized to engage with corrugations of the second corrugated shell 720. The coupler 750 can include an upper end 752. The upper end 752 can include an outer rim. The outer rim can be circular or another shape. The outer rim can include a plurality of internal threads. The internal threads can engage with corrugations of the second corrugated shell 730. An inner diameter of the outer rim of the upper end 752 can be greater than an outer diameter of the outer rim of the lower end 751. An outer surface of the outer wall of the upper end 752 can be tapered.

The first corrugated shell 720 and/or the second corrugated shell 730 can be welded or otherwise mechanically fastened with the coupler 750. Alternatively, the coupler 750 does not include internal threads and the first corrugated shell 720 and/or the second corrugated shell 730 are welded or otherwise mechanically fastened with the coupler 750.

The coupler 750 can include a central portion 753. The central portion 753 can entirely or partially span between the outer rims of the upper and lower ends 751, 752. In certain implementations, the central portion 753 can include one or more apertures therethrough. The first corrugated shell 720 can abut the central portion 753. The second corrugated shell 730 can abut the central portion 753. In certain implementations, the corrugated shell 720 and/or 730 can be welded with the central portion 753.

Figure 18:
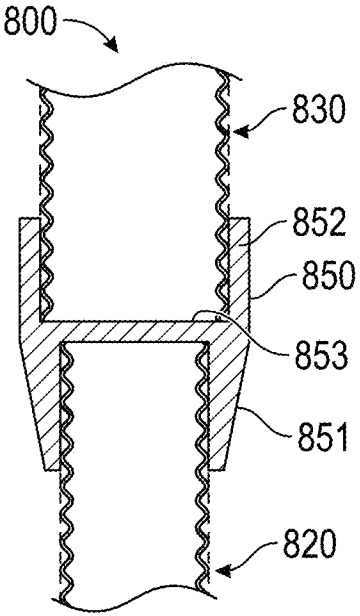
FIG. 18 shows a cross-section of the first coupler of FIG. 14.

FIG. 18 shows a detailed cross-section of the coupler 850 of FIG. 14. The coupler 850 has a lower end 851. The lower end 851 can be defined by an outer rim. The outer rim can be circular or another shape. The outer rim can include a plurality of internal threads. The internal threads can be sized to engage with corrugations of the second corrugated shell 820. The coupler 850 can include an upper end 852. The upper end 852 can include an outer rim. The outer rim can be circular or another shape. The outer rim can include a plurality of internal threads. The internal threads can engaging with corrugations of the second corrugated shell 830. An inner diameter of the outer rim of the upper end 852 can be less than an outer diameter of the outer rim of the lower end 851. An outer surface of the outer wall of the lower end 851 can be tapered.

The first corrugated shell 820 and/or the second corrugated shell 830 can be welded or otherwise mechanically fastened with the coupler 850. Alternatively, the coupler 850 does not include internal threads and the first corrugated shell 820 and/or the second corrugated shell 830 are welded or otherwise mechanically fastened with the coupler 850.

The coupler 850 can include a central portion 853. The central portion 853 can entirely or partially span between the outer rims of the upper and lower ends 851, 852. In certain implementations, the central portion 853 can include one or more apertures therethrough. The first corrugated shell 820 can abut the central portion 853. The second corrugated shell 830 can abut the central portion 853. In certain implementations, the corrugated shell 820 and/or 830 can be welded with the central portion 853.

Figure 19:
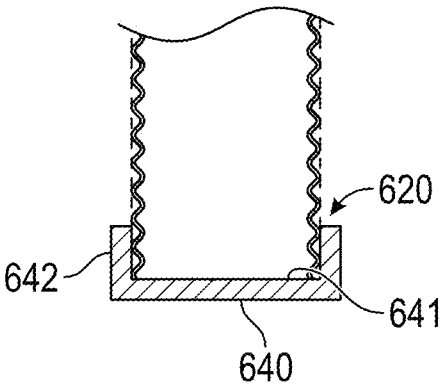
FIG. 19 shows a cross-section of a cap of FIG. 12.

With reference to FIG. 19, the cap 640 of FIG. 12 can be attached with the end of the corrugated shell 620. The cap 640 can include a central portion 641. The central portion 641 can enclose the end of the first corrugated shell 620. In certain implementations, the central portion 641 can be include a flat or planar, domed, pointed or any other shaped closure to facilitate entry into a subsoil. The cap 640 can include a rim 642. The rim 642 can receive the corrugated shell 620. The rim 642 can include a plurality of threads. The plurality of threads can engage with the fluting of the first corrugated shell 620. In other implementations, the first corrugated shell 620 can be welded or otherwise mechanically attached with the rim 642.

Figure 20:
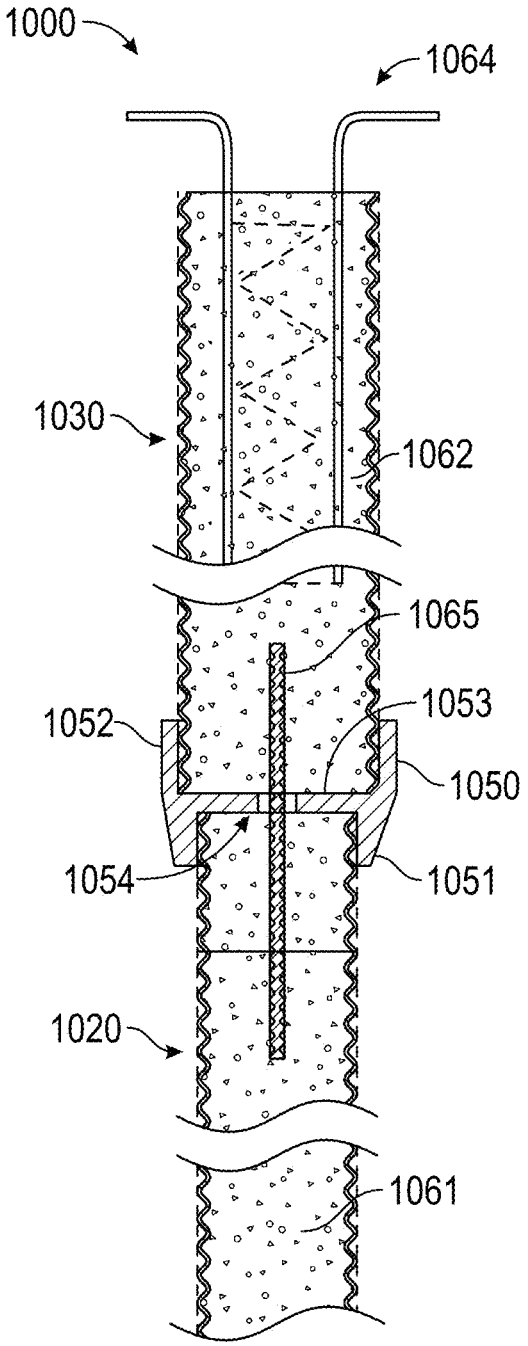
FIG. 20 shows a cross-section of another variation of a bearing pile.

FIG. 20 illustrates another implementation of a bearing pile 1000. The bearing pile 1000 can comprise a first corrugated shell 1020 and a second corrugated shell 1030 connected by a coupler 1050. The first corrugated shell 1020 has a first outer diameter that is less than a second outer diameter of the second corrugated shell 1030. The coupler 1050 can include a lower end 1051 and an upper end 1052. The lower end 1051 can be sized to receive the first outer diameter (e.g., within an outer rim). The upper end 1052 can be sized to receive the second outer diameter (e.g., within an outer rim).

The first corrugated shell 1020 can be filled with a filler material 1061. The second corrugated shell 1030 can be filled with a filler material 1062. A reinforcing cage 1064 can be cast in-place in the second corrugated shell 1030. The reinforcing cage 1064 can comprise a plurality of rebar rods wired or otherwise joined together. Upper ends of the rods can project from the second corrugated shell 1030. The projecting ends of the reinforcing cage 1064 can be coupled with (e.g., cast within) a pile cap (not shown), mat (not shown) or slab (not shown). When an upper end of a bearing pile (e.g. second corrugated shell 1030) is subjected to moment, and/or shear forces, the upper end can deflect beyond tolerable limits. Accordingly, the reinforcing cage 1064 can resist these forces so deflections are within tolerable limits.

An advantage of a bearing pile according to the present disclosure is that upper corrugated shells can have a greater diameter than lower corrugated shells (e.g., first corrugated shell 1020). A greater diameter in the upper corrugated shell can better resist and mitigate transverse movement. A greater diameter in the upper corrugated shell can also permit the design of a less costly reinforcing cage. The reinforcing cage may be tapered as it extends downward inside the pile.

The bending resistance of a reinforcing cage can be improved by increasing its diameter. As the cage diameter is increased the size and weight of the reinforcing bars may be decreased. The reduction in the cost of the reinforcing cage material may exceed the incremental cost of enlarging the shell diameters at the upper end of the pile thereby providing an additional net savings.

In certain implementations, the coupler 1050 can include an aperture 1054 in the central portion 1053. The aperture 1054 can be a central aperture. The filler material 1061 and/or filler material 1062 can partially or fully fill the aperture 1054. A rod 1065 can be cast within the filler material 1061 and the filler material 1062 (e.g., spanning between the first and second corrugated shells 1020, 1030). The rod 1065 can extend through the aperture 1054. The rod 1065 can comprise one or more rebar rods or other elongate structures.

Figure 21:
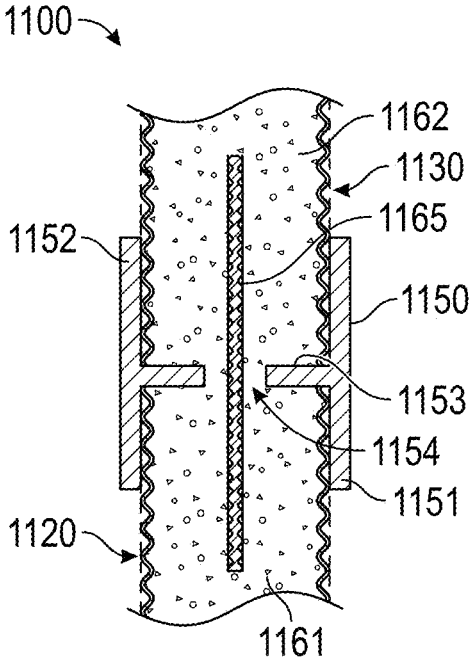
FIG. 21 shows a cross-section of another variation of a bearing pile.

FIG. 21 illustrates another implementation of a bearing pile 1100. The bearing pile 1100 can comprise a first corrugated shell 1120 and a second corrugated shell 1130 connected by a coupler 1150. The first corrugated shell 1120 has a first outer diameter. The second corrugated shell 1130 has a second outer diameter. The first and second outer diameters can be equal or approximately equal. The coupler 1150 can include a lower end 1151 and an upper end 1152. The lower end 1151 can be sized to receive the first outer diameter (e.g., within an outer rim). The upper end 1152 can be sized to receive the second outer diameter (e.g., within an outer rim).

The first corrugated shell 1120 can be filled with a filler material 1161. The second corrugated shell 1130 can be filled with a filler material 1162. In certain implementations, the coupler 1150 can include an aperture 1154 in the central portion 1153. The aperture 1154 can be a central aperture. The filler material 1161 and/or filler material 1162 can partially or fully fill the aperture 1154. A rod 1165 can be cast within the filler material 1161 and the filler material 1162 (e.g., spanning between the first and second corrugated shells 1120, 1130). The rod 1165 can extend through the aperture 1154. The rod 1165 can comprise one or more rebar rods or other elongate structures.

CERTAIN TERMINOLOGY

Terms of orientation used herein, such as "top," "butt," "bottom," "tip," "joiner," "coupler," "sleeve," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

Summary

Several illustrative examples of bearing piles have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one example in this disclosure can be combined or used with (or instead of) any other portion of any of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are not all drawn and/or shown to scale, but such scale should nevertheless not be limiting, since dimensions and proportions other than what are shown are contemplated and are within the scope of the disclosed inventions. Distances, angles, etc. are merely illustrative and do not limit the relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

What is claimed is:

1. A method of forming a foundational piling in a subsoil, comprising:

attaching a cap with a first end of a first corrugated shell, the first corrugated shell comprising corrugated steel pipe having a plurality of corrugations, the cap enclosing the first end of the first corrugated shell;

inserting a drive mandrel into the first corrugated shell through a second end of the first corrugated shell, the drive mandrel having a mandrel length;

aligning the first corrugated shell with the subsoil along a generally vertical or battered direction, the cap of the first corrugated shell contacting the subsoil and the second end of the first corrugated shell located above the subsoil;

placing a pile impact or vibratory hammer in contact with an upper end of the drive mandrel, a lower end of the drive mandrel contacting the cap;

applying a driving force to the drive mandrel in a generally vertical or battered direction using the pile impact or vibratory hammer, the driving force transmitting along the mandrel to the first corrugated shell through the cap such that the first corrugated shell is tensioned during driving;

driving, pressing or vibrating the first end of the first corrugated shell into the subsoil with the driving force, press force or vibrational force to attain a first fill position in which a majority of the length of the first corrugated shell is embedded within the subsoil and the second end of the first corrugated shell is located between approximately 6 inches and 36 inches above the subsoil;

removing the mandrel from the first corrugated shell;

substantially filling the first corrugated shell from the first end to the second end with a flowable concrete mix in the first fill position;

attaching a coupler sleeve with the first corrugated shell by assembling a first rim of a first end of the coupler sleeve over the second end of the first corrugated shell and engaging the corrugations of the first corrugated shell with internal threads of the first end of the coupler sleeve;

aligning a second corrugated shell with the first corrugated shell, the second end of the first corrugated shell located above the subsoil, the second corrugated shell comprising corrugated steel pipe having a plurality of corrugations;

attaching the second corrugated shell with the coupler sleeve by assembling a first end of the second corrugated shell within a second rim of a second end of the coupler sleeve opposite the first end and engaging the corrugations of the second corrugated shell with internal threads of the second end of the coupler sleeve;

inserting the drive mandrel into the second corrugated shell through a second end of the second corrugated shell;

placing a pile impact or vibratory hammer in contact with the upper end of the drive mandrel, the lower end of the drive mandrel contacting the solid concrete of, or a steel plate on, the first corrugated shell;

applying the driving force to the drive mandrel in a generally vertical or battered direction using the pile impact or vibratory hammer, the driving force transmitting along the mandrel to the first and second corrugated shells such that the second corrugated shell is tensioned during driving and the first corrugated shell and the solid concrete is compressed during driving;

driving, pressing or vibrating the first and second corrugated shells into the subsoil with the driving force, press force or vibrational force to attain a second fill position in which the first corrugated shell is buried within the subsoil and a majority of the second corrugated shell is buried within the subsoil;

removing the mandrel from the second corrugated shell;

inserting a first end of a reinforcing cage into the second end of the second corrugated shell, a second end of the reinforcing cage protruding therefrom; and substantially filling the second corrugated shell from the first end to the second end with a flowable concrete mix, wherein the concrete mix also surrounds an embedded portion of the cage;

wherein the subsoil is forced into valleys of the corrugations of the first and second corrugated shells during driving such that a piling capacity of the foundational piling is at least partially determined by a soil/soil shear interface between the subsoil trapped within the valleys and the subsoil surrounding an outer circumferential wall of the first and second corrugated shells;

wherein the length of the first corrugated shell is up to about 90 feet and the length of the second corrugated shell is up to about 90 feet;

wherein the corrugations of the first and second corrugated shells have a helix angle between about 4 degrees and 45 degrees;

wherein the corrugations of the first and second corrugated shells have a pitch distance (crest to crest) of between about ¼ inches and 6 inches;

wherein the corrugations of the first and second corrugated shells have a flute depth between about ¼ inches and 3 inches;

wherein the first and second corrugated shells have a wall thickness between about 0.03 inches and ¼ inches; and wherein the first and second corrugated shells each have a diameter between about 6 inches and 36 inches.

2. A method of forming a foundational piling in a subsoil, comprising:

attaching a cap with a first end of a first corrugated shell, the first corrugated shell comprising corrugated steel pipe having a plurality of corrugations;

aligning the first corrugated shell with the subsoil along an insertion direction, the cap of the first corrugated shell contacting the subsoil and a second end of the first corrugated shell located above the subsoil;

applying a driving force, press force or vibrational force to the first corrugated shell in the insertion direction with a pile impact or vibratory hammer;

driving, pressing or vibrating the first end of the first corrugated shell into the subsoil with the driving force, press force or vibrational force to attain a first fill position in which a majority of the length of the first corrugated shell is buried within the subsoil and the second end of the first corrugated shell is located above the subsoil, wherein the subsoil is forced into valleys of the plurality of corrugations of the first corrugated shell during driving;

substantially filling the first corrugated shell with a flowable concrete mix in the first fill position;

coupling a first end of a second corrugated shell with the second end of the first corrugated shell to form a shell assembly, the second corrugated shell comprising corrugated steel pipe having a plurality of corrugations;

aligning the second corrugated shell with the first corrugated shell along the insertion direction, the second end of the first corrugated shell located above the subsoil;

applying the driving force, press force or vibrational force to the second corrugated shell in the insertion direction with a pile impact or vibratory hammer;

driving, pressing or vibrating the shell assembly into the subsoil with the driving force, press force or vibrational force to attain a second fill position in which the length of the first corrugated shell is buried within the subsoil and a majority of a length of the second corrugated shell is buried within the subsoil; and substantially filling the second corrugated shell with a flowable concrete mix.

3. The method of claim 2, further comprising:

inserting a drive mandrel into the second corrugated shell through the second end of the second corrugated shell to apply the driving force to the second corrugated shell in the insertion direction.

4. The method of claim 3, wherein the insertion direction is generally vertical or along a specified batter.

5. The method of claim 4, further comprising:

attaching a coupler with the first corrugated shell by assembling a first rim of a first end of the coupler over the second end of the first corrugated shell; and attaching the second corrugated shell with the coupler by assembling a first end of the second corrugated shell within a second rim of a second end of the coupler opposite the first end.

6. The method of claim 5, further comprising:

engaging the corrugations of the first corrugated shell with internal threads of the first end of the coupler; and engaging the corrugations of the second corrugated shell with internal threads of the second end of the coupler.

7. The method of claim 5, wherein a lower end of the drive mandrel bears upon a central portion of the coupler.

8. The method of claim 2, wherein the second corrugated shell has an outer diameter less than an outer diameter of the first corrugated shell.

9. The method of claim 2, wherein the second corrugated shell has an outer diameter greater than an outer diameter of the first corrugated shell.

10. The method of claim 2, wherein the subsoil is forced into valleys of the plurality of corrugations of the first corrugated shell during driving such that a piling capacity of the foundational piling is at least partially determined by a soil/soil interface between the subsoil within the valleys and the subsoil around the first corrugated shell.

11. The method of claim 2, further comprising:

inserting a first end of a coupling rod in the flowable concrete mix in the second end of the first corrugated shell; and inserting a second end of the coupling rod within the first end of the second corrugated shell when attaching the second corrugated shell with the first corrugated shell.

12. The method of claim 2, wherein the length of the first corrugated shell is up to about 90 feet and the length of the second corrugated shell is up to about 90 feet.

13. The method of claim 2, wherein the corrugations of the first and second corrugated shells have a helix angle between about 4 degrees and 45 degrees.

14. The method of claim 2, wherein the corrugations of the first and second corrugated shells have a pitch distance (crest to crest) of between about ¼ inches and 6 inches.

15. The method of claim 2, wherein the corrugations of the first and second corrugated shells have a flute depth between about ¼ inches and 3 inches.

16. The method of claim 2, wherein the first and second corrugated shells have a wall thickness between about 0.03 inches and ¼ inches.

17. The method of claim 2, wherein the first and second corrugated shells each have a diameter between about 6 inches and 36 inches.

18. The method of claim 2, wherein the plurality of corrugations of the first corrugated shell have a standard profile.

19. The method of claim 2, further comprising inserting a first end of a reinforcing cage into the second end of the second corrugated shell, a second end of the reinforcing cage protruding therefrom.

20. The method of claim 2, wherein the first end of the first corrugated shell is received within an outer rim of the cap.

21. The method of claim 2, further comprising:

coupling a third corrugated shell with the second end of the second corrugated shell, the third corrugated shell comprising corrugated steel pipe having a plurality of corrugations;

applying the driving force, press force or vibrational force to the third corrugated shell in the insertion direction;

driving, pressing or vibrating the shell assembly into the subsoil with the driving force, press force, or vibration force to attain a third fill position in which the length of the first and second corrugated shells are buried within the subsoil and a majority of a length of the third corrugated shell is buried within the subsoil; and substantially filling the third corrugated shell with a flowable concrete mix.

22. The method of claim 21, wherein the second corrugated shell has an outer diameter less than an outer diameter of the first corrugated shell and the third corrugated shell has an outer diameter less than the outer diameter of the first corrugated shell.

23. The method of claim 21, wherein the second corrugated shell has an outer diameter greater than an outer diameter of the first corrugated shell and the third corrugated shell has an outer diameter greater than the outer diameter of the second corrugated shell.

24. A foundational piling in a subsoil, comprising:

a first corrugated shell comprising corrugated steel pipe having a plurality of corrugations, wherein a length of the first corrugated shell is up to about 90 feet and the outer diameter of the first corrugated shell is between about 6 inches and 36 inches;

a cap attached to a first end of the first corrugated shell, the first corrugated shell aligned in a substantially vertical direction or a battered direction;

a first cured concrete section substantially filling the first corrugated shell from the first end to a second end of the first corrugated shell;

a second corrugated shell comprising corrugated steel pipe having a plurality of corrugations, wherein a length of the second corrugated shell is up to about 90 feet and an outer diameter of the second corrugated shell is between about 6 inches and 36 inches;

a first end of the second corrugated shell attached with the second end of the first corrugated shell using a coupler with helical grooves that substantially match the corrugations of the first and second corrugated shells; and a second cured concrete section substantially filling the second corrugated shell.

25. The piling of claim 24, wherein the coupler includes a central portion separating the first cured concrete section and the second cured concrete section.

26. The piling of claim 25, wherein the coupler includes a first end having a first rim and a second end having a second rim, the second end of the first corrugated shell received within the first rim and the first end of the second corrugated shell receive within the second rim.

27. The piling of claim 26, wherein the corrugations of the second end of the first corrugated shell are engaged within the first end of the coupler.

28. The piling of claim 24, further comprising a reinforcing cage embedded in the second cured concrete section and extending from the second end of the second corrugated shell.

29. The piling of claim 24, wherein the outer diameter of the second corrugated shell is less than the outer diameter of the first corrugated shell.

30. The piling of claim 24, wherein the outer diameter of the second corrugated shell is greater than the outer diameter of the first corrugated shell.

* * * * *